US006388392B1

(12) United States Patent
Flory, IV

(10) Patent No.: US 6,388,392 B1
(45) Date of Patent: May 14, 2002

(54) SYSTEM FOR PROVIDING AUXILIARY POWER TO LIGHTING UNIT FOR HEAVY EQUIPMENT HAVING A DIRECT CURRENT POWER SUPPLY AND NO UNINTERRUPTIBLE POWER SUPPLY

(75) Inventor: Isaac L. Flory, IV, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/274,954

(22) Filed: Mar. 23, 1999

(51) Int. Cl.[7] ..... G05F 1/00

(52) U.S. Cl. ..... 315/291; 315/307; 315/209 CD; 315/363

(58) Field of Search ..... 315/240, 241 R, 315/58, 363, 307, 291, 219, 119, 224, 127, 232, 209; 363/60; 307/148, 64, 66, 44, 46, 48; 320/1, 2, 5, 7, 10, 13

(56) References Cited

U.S. PATENT DOCUMENTS

| | | | | | |
|---|---|---|---|---|---|
| 3,631,259 | A | * | 12/1971 | Kiyota | 320/1 |
| 4,488,104 | A | | 12/1984 | Suzuki | 320/1 |
| 4,560,908 | A | | 12/1985 | Stupp et al. | 315/219 |
| 4,749,908 | A | * | 6/1988 | Stifter | 315/86 |
| 4,954,754 | A | | 9/1990 | Nilssen | 315/219 |
| 4,999,547 | A | | 3/1991 | Ottenstein | 315/307 |
| 5,111,058 | A | * | 5/1992 | Martin | 307/66 |
| 5,138,234 | A | | 8/1992 | Moisin | 315/209 |
| 5,196,766 | A | * | 3/1993 | Beggs | 315/241 R |
| 5,241,217 | A | * | 8/1993 | Severinsky | 307/64 |
| 5,384,518 | A | | 1/1995 | Kido et al. | 315/225 |
| 5,444,310 | A | * | 8/1995 | Kataoka et al. | 307/125 |
| 5,532,572 | A | | 7/1996 | Okamura | 320/1 |
| 5,572,108 | A | | 11/1996 | Windes | 320/1 |
| 5,608,614 | A | * | 3/1997 | Ohnishi et al. | 363/60 |
| 5,615,096 | A | * | 3/1997 | Stengel et al. | 363/60 |
| 5,619,076 | A | | 4/1997 | Layden et al. | 307/48 |
| 5,625,544 | A | * | 4/1997 | Kowshik et al. | 363/59 |
| 5,793,123 | A | * | 8/1998 | Ho et al. | 307/66 |
| 5,796,182 | A | * | 8/1998 | Martin | 307/66 |
| 5,831,469 | A | * | 11/1998 | Menichelli | 327/536 |
| 5,912,560 | A | * | 6/1999 | Pasternak | 324/536 |
| 6,008,690 | A | * | 12/1999 | Takeshima et al. | 327/534 |

* cited by examiner

*Primary Examiner*—Don Wong
*Assistant Examiner*—Tuyet T. Vo
(74) *Attorney, Agent, or Firm*—Aisha Ahmad; Stacey J. Longanecker; Alfred N. Goodman

(57) ABSTRACT

An apparatus for providing auxiliary power to a lighting system for heavy equipment during interruptions of power from a 250 volt direct current (DC) power supply is provided. The DC power supply is the only power source available to discharge lamps provided on the heavy equipment. The energy storage banks are provided between the power supply and a ballast for operating a gas discharge lamp. The energy storage banks store energy and provide the reserved energy to the ballast when the supply voltage to the ballast decreases below a level necessary for sustaining operating of the discharge lamp. The energy storage banks can comprise capacitors arranged in various series and parallel circuits and a blocking rectifier to prevent non-lighting loads on the heavy equipment from draining the energy storage banks.

11 Claims, 5 Drawing Sheets

SYSTEM FOR PROVIDING AUXILIARY POWER TO LIGHTING UNIT FOR HEAVY EQUIPMENT HAVING A DIRECT CURRENT POWER SUPPLY AND NO UNINTERRUPTIBLE POWER SUPPLY

FIELD OF THE INVENTION

The invention relates to an apparatus for providing auxiliary power to a lighting unit for heavy equipment during interruptions of power from a direct current power supply.

BACKGROUND OF THE INVENTION

Heavy equipment is often used in harsh environments characterized by severe temperatures, poor air quality, the handling of dangerous materials, among other conditions. For example, the large electromagnetic cranes that are used in a steel mill for handling ingot and containers of molten steel can be subjected to high temperatures, as well as sparks from the steel manufacturing process.

An exemplary electromagnetic crane 10 is depicted in FIG. 1. A crane is generally transported on rails 12 and 14 provided on the floor 16 or elevated above the floor of the steel mill. The rails 12 and 14 provide power from a direct current (DC) power supply 18 (e.g., a 250 volt DC (VDC) power supply) to a power bus 20 in the crane. The power bus 20 (e.g., a 250 VDC bus) is provided in one of the rails 12. The other rail 14 can provide the common or ground connection. The crane 10 has a horizontal section 26 which is provided with shoes 22 or other means that cooperate with the rails to guide the section 26 along the rails 12 and 14 and to prevent derailment of the crane. A section of the interior of the horizontal section 26 is illustrated to depict the contacts or brushes 24 provided on the crane for conducting a voltage provided via the power bus 20. Components on the crane that require power such as a luminaire 30, motors and control circuits are connected to the power bus 20. These types of cranes are generally only powered by a 250 VDC power supply 18 and therefore provide the only available power source for loads such as a luminaire 30. In addition, these cranes are typically not provided with uninterruptible power supplies (UPSs) because UPSs are regarded as too costly and not able to withstand the harsh conditions in which the cranes are used.

To ensure the safety of steel mill workers, many of the cranes used in the mill are automated or remotely controlled. Some cranes, however, can be manually operated by human operators located in a cab on the crane. Lighting is important to avoid mishandling of the steel, the crane and the various devices used during the manufacture of steel products (e.g., cauldrons for molten steel), particularly when the crane is manually operated by a human operator (i.e., controlled remotely or from within a cab on the crane). A number of existing cranes use either incandescent or high intensity discharge (HID) lamps which are subjected to intermittent power outages. For example, supply voltage to the crane can be interrupted by intermittent brush connections between the crane and the powered rails when the crane is in motion. In addition, electromagnets used on the crane to operate a boom, winch, grasping tool or other tool draw sufficient energy from the power bus to decrease, for varying periods of time, the system voltage provided to the crane by more than two-thirds. For example, the system voltage can decrease to 90 VDC or lower in a crane or other system using a 250 VDC power source. In the case of a conventional alternating current or AC-driven ballast, a voltage drop of this magnitude would cause the lamp to be extinguished.

Direct current ballasts for HID lamps have been employed that have some degree of energy storage capability and can therefore withstand some interruptions in the supply voltage. These DC ballasts, however, are not able to prevent the lamp from being extinguished by the types of power interruptions that are common in the environments in which cranes and similar heavy equipment are used. While incandescent lamps do not cease operating as a result of voltage drop-off, they do not provide as much output and have a shorter operational life.

A need therefore exists for a device which provides a supply voltage to discharge lamps on heavy equipment when the supply of power between the heavy equipment and its power source is interrupted. A need also exists for a device which can supply a voltage to the heavy equipment lamps during power outages that does not require an auxiliary power source such as batteries or an AC power supply.

SUMMARY OF THE INVENTION

The above-described problems with lighting units for heavy equipment having only a DC power supply as a power source for the lighting units are overcome by the present invention.

In accordance with an aspect of the present invention, an energy storage bank is provided to ensure continued operation of the lighting unit during supply voltage drop-offs.

In accordance with another aspect of the present invention, a blocking rectifier is provided between the power supply and the energy storage bank to prevent bleedback to non-lighting loads in the power distribution system of the heavy equipment.

In accordance with yet another aspect of the present invention, the energy storage bank stores energy and provides the reserved energy to the ballast of a discharge lamp when the supply voltage to the ballast decreases below a level necessary for sustaining operation of the discharge lamp.

In accordance with still yet another aspect of the present invention, the energy storage bank comprises capacitors arranged in various series and parallel circuits.

In accordance with another aspect of the present invention, plurality energy storage banks can be arranged in parallel with respect to the ballast to increase the amount of power that is reserved to ensure continued operation of a discharge lamp following a sudden voltage drop-off.

A lighting system for machinery powered via a supply line connected to a direct current power supply is provided. The supply line provides a predetermined steady-state potential and the machinery is provided with a discharge lamp and ballast connected to the supply line. The lighting system comprises an energy storage bank connected in parallel with respect to the direct current power supply and the ballast. The energy storage bank comprises at least one capacitor and is operable to maintain a voltage across the ballast corresponding approximately to the steady-state potential of the supply line, and to discharge and provide an adequate voltage across the ballast to maintain operation of the lamp when power from the supply line to the ballast decreases below a selected voltage such as the rated voltage of a selected ballast.

In accordance with another aspect of the present invention, the selected voltage corresponds to a nominal operating voltage for the ballast to sustain operation of a gas discharge lamp.

A lighting system for machinery powered via a supply line connected to a direct current power supply is provided.

The supply line provides a predetermined steady-state potential and the machinery is provided with a discharge lamp and ballast connected to the supply line and comprises non-lighting loads. The lighting system comprises an energy storage bank connected in parallel with respect to the direct current power supply and the ballast. The energy storage bank comprises at least one capacitor and is operable to maintain a voltage across the ballast corresponding approximately to the steady-state potential of the supply line, and to discharge and momentarily sustain a voltage across the ballast when power from said supply line to the ballast decreases below a rated voltage for a selected ballast. In addition, the lighting system comprises a bleedback device connected in series between the direct current power supply and the energy storage bank which is operable to prevent any of the non-lighting loads from draining power provided by the energy storage bank when power from the supply line to the ballast decreases below the rated voltage.

BRIEF DESCRIPTION OF DRAWINGS

The various aspects, advantages and novel features of the present invention will be more readily comprehended from the following detailed description when read in conjunction with the appended drawings, in which.

Throughout the drawing figures, like reference numerals will be understood to refer to like parts and components.

DETAILED DESCRIPTION OF THE PREFERRED EMBODIMENTS

Figure 1:
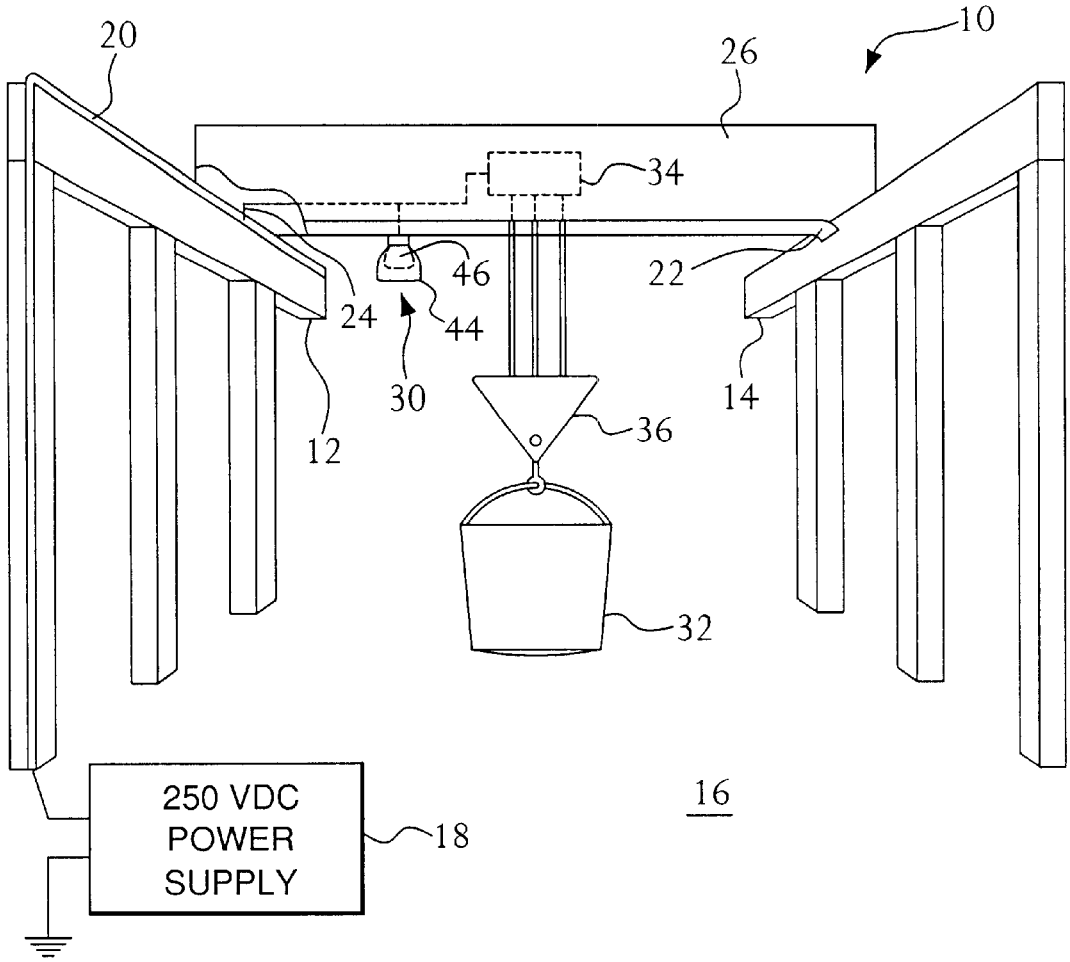
FIG. 1 depicts heavy equipment having a luminaire and a direct current power source for use with the apparatus of the present invention.
Figure 2:
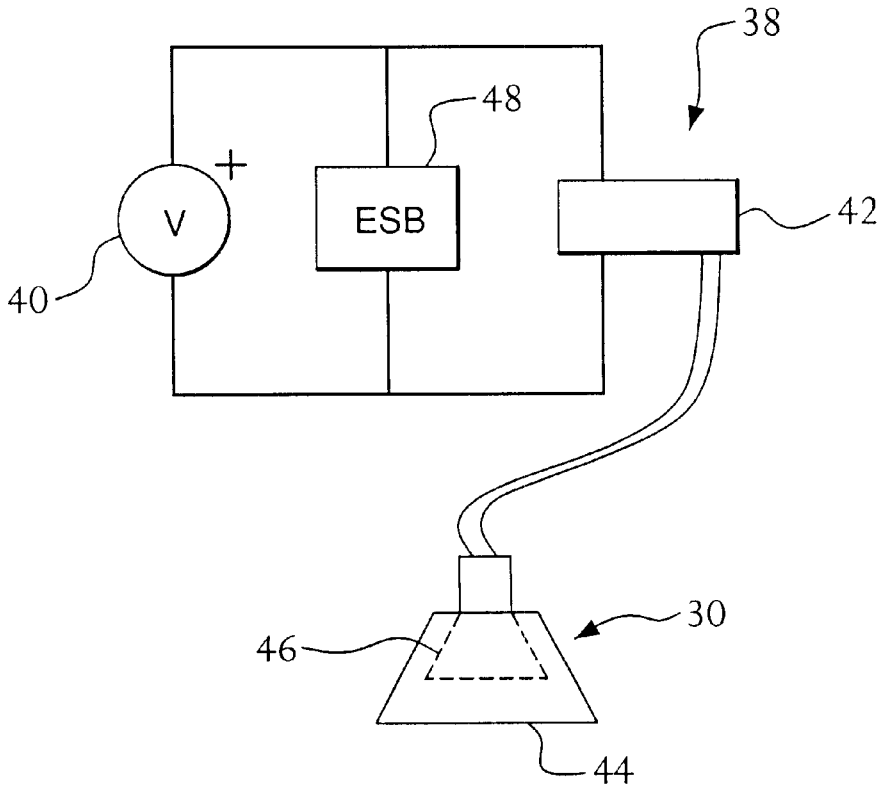
FIG. 2 is a circuit diagram of a lighting system constructed in accordance with an embodiment of the present invention.

With reference to FIG. 2, a lighting system 38 constructed in accordance with an embodiment of the present invention operates in conjunction with the direct current power supply of a piece of heavy machinery. For illustrative purposes, the present invention will be described in connection with the 250 VDC power supply 18 of the crane 10 depicted in FIG. 1. The power supply 18 is illustrated in FIG. 2 as a voltage source 40 for providing a substantially flat DC signal across the ballast 42 of the luminaire 30 provided on the crane 10. The ballast is preferably an electronic HID ballast which is capable of operating from a 250 VDC power supply. Such a ballast is commercially available from WPI Electronics Inc., Warner, N.H. The luminaire 30 also comprises an optical assembly 44 and an HID lamp 46. The optical assembly 44 is constructed to withstand the demanding physical environment associated with the operation of the crane. In accordance with an aspect of the present invention, an energy storage bank (ESB) 48 is provided which is parallel with respect to the voltage source 40 and the ballast 42.

The ESB 48 is preferably a capacitance device that stores energy. As stated previously, heavy equipment is susceptible to interruptions in power due to intermittent brush connections with the power bus 20, and voltage drop-offs due to the drain of electromagnets 34 on the system power supply when the electromagnets are used to move the crane 10 or operate a tool 36 on the crane. When such sudden supply voltage decreases occur, the ballast 42 may not be able to sustain operation of the lamp 46 and the lamp is extinguished. In accordance with the present invention, the ESB 48 provides temporary and sufficient power to the ballast to allow for the continued operation of the lamp during sudden supply voltage drop-offs. The ESB 48 floats at the steady-state potential of the supply line. For a particular amount of voltage drop-off, the ESB 48 supplies an adequate amount of energy to maintain operation of the lamp. The amount of current drawn by the load (e.g., a lighting load) is a function of the capacitive energy of the ESB 48 at a given time and of the amount of voltage drop-off.

Figure 3:
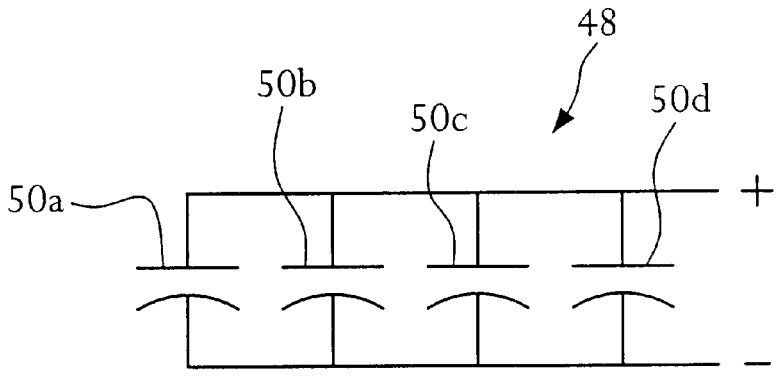
FIG. 3 is a circuit diagram of an energy storage bank constructed in accordance with an embodiment of the present invention.
Figure 4:
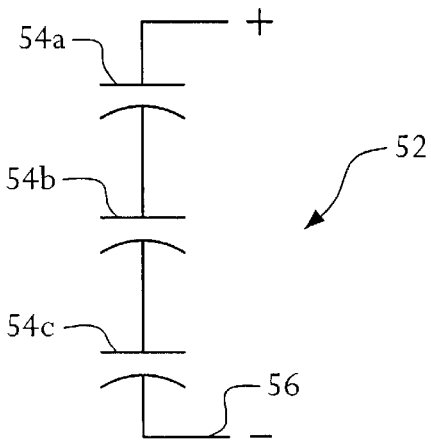
FIG. 4 is a circuit diagram of an energy storage bank constructed in accordance with an embodiment of the present invention.
Figure 5:
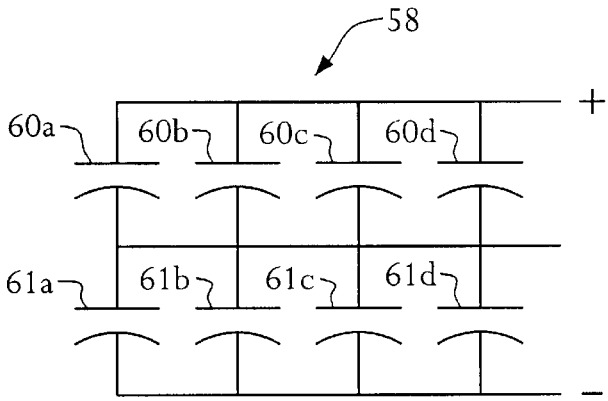
FIG. 5 is a circuit diagram of an energy storage bank constructed in accordance with an embodiment of the present invention.

The ESB 48 comprises at least one capacitor connected across the ballast 42. A capacitor in the ESB 48 stores energy and is operable to discharge and provide energy to the ballast 42 when the supply voltage decreases below the rated voltage level of the ballast. The ESB 48 is preferably a set of capacitors arranged in parallel, in series, or in both parallel and series configurations. For example, the ESB 48 can be a battery of 55 microfarad capacitors, as described below. The capacitors are preferably rated at a higher voltage than the rated voltage of the ballast (e.g., 300 V for a rated ballast voltage of 250 V). FIG. 3 depicts an exemplary ESB 48 comprising several capacitors 50*a*, 50*b*, 50*c* and 50*d* connected in parallel with respect to each other and the ballast. FIG. 4 depicts another exemplary ESB 52 comprising several capacitors 54*a*, 54*b* and 54*c* connected in a series circuit 56. The series circuit 56 is connected in parallel with respect to the ballast. Alternatively, the ESB 48 can be configured as the ESB 58 depicted in FIG. 5 which comprises a number of parallel capacitors 60*a*, 60*b*, 60*c* and 60*d*. These parallel capacitors are connected in series with parallel capacitors 61*a*, 61*b*, 61*c* and 61*d*. The series circuit, in turn, is connected in parallel with respect to the ballast 42.

Figure 6:
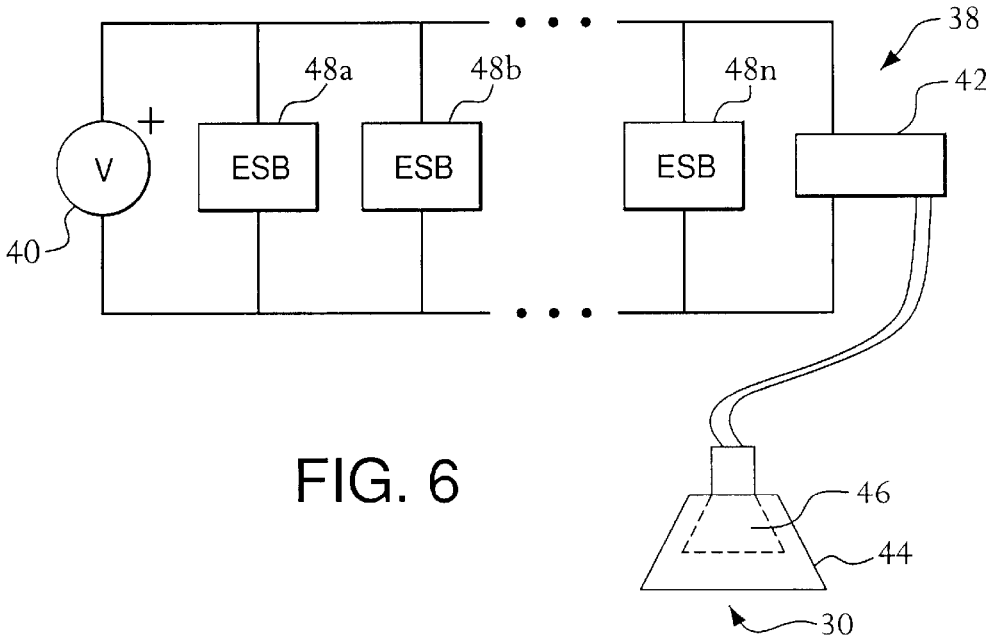
FIG. 6 is a circuit diagram of a lighting system constructed in accordance with an embodiment of the present invention.

As shown in FIG. 6, more than one ESB 48 (i.e., ESB 48*a*, ESB 48*b*, . . . . ESB 48*n*) can be connected in parallel with respect to the ballast 42. The more ESBs 48 that are used in this configuration, the more energy that is stored and reserved for supply to the ballast 42 when the supply voltage decreases below a rated voltage level for the ballast, that is, the nominal voltage level required at the ballast for operating the lamp 46. For example, when the input voltage supplied to the ballast 42 in the lighting system 38 decreases below 120 VDC, a nominal HID lamp 46 will extinguish. For a ballast 42 which can operate from a 250 VDC power source, the input voltage is 250 VDC (nominal) and the input current is 1.9 amperes DC (ADC) at 250 VDC. For a situation wherein total voltage drop-off occurs, the following calculation provides an approximate indication of how long a lamp can be sustained by an ESB in accordance with the present invention. Power is determined to be (1.9 A)(250V) or 475 watts. If the current draw of the ballast 42 is considered to be inversely proportional to the input voltage, then the period of time t that an ESB 48 can maintain operation of the lamp is defined as follows:

$$C(dV/dt)=-475/V$$

$$V(dV)=-475/C(dt)$$

$$V^2/2=-475/(C*t)+K$$

$$V=(2K-(950/C*t))^{1/2}$$

For $V(0)=V_o=250=(2K)^{1/2}$, then $K=31{,}250$.

Thus, $V(t)=(62{,}500-(950/C*t))^{1/2}$.

Accordingly, for V=120, t=50.63C seconds where C is the equivalent ESB capacitance. Thus, the larger the value of C, that is, the more ESBs that are employed in the lighting system 38, the longer the operation of the lamp 46 is sustained following a significant decrease in the supply voltage.

Figure 7:
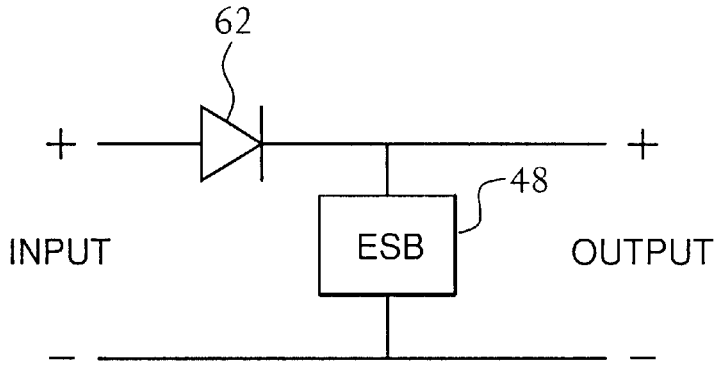
FIG. 7 is a circuit diagram of an external rectifier and energy storage bank in accordance with an embodiment of the present invention.
Figure 8:
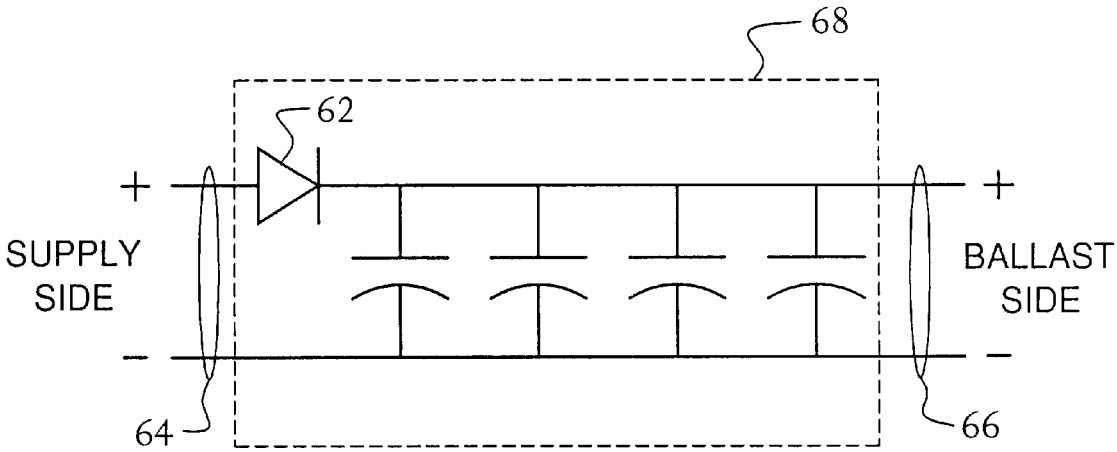
FIG. 8 is a circuit diagram of an energy storage bank having an internal rectifier in accordance with an embodiment of the present invention.

Another consideration when using the lighting system 38 of the present invention is the system drain on the ESB(s) 48 from other devices in the lighting system. As stated previously, the direct current power supply 18 provides power via a power bus 20 to non-lighting loads in the crane 10 such as motors and control devices, in addition to one or more luminaires 30. When a decrease in the supply voltage occurs (e.g., due to intermittent brush contact with the power bus 20), energy from the ESB(s) 48 can be drained by any non-lighting loads connected to the power bus 20. This situation is hereinafter referred to as bleedback. In accordance with another aspect of the present invention, a blocking rectifier 62 is provided in series with the input of the ESB 48, as shown in FIG. 7, to allow current flow in only one direction relative to the power source 40 FIG. 2). A blocking rectifier 62 can be arranged integrally in an ESB 48, as illustrated in FIG. 8 and referred to generally as ESB 68. The ESB 68 in FIG. 8 therefore has dedicated inputs 64 and outputs 66 for connection to the supply side and the ballast side, respectively, of the lighting system 38. Thus, a single ESB 48 can be used in conjunction with a single rectifier 62 which can, but need not be, internal to the ESB of the present invention.

Figure 9:
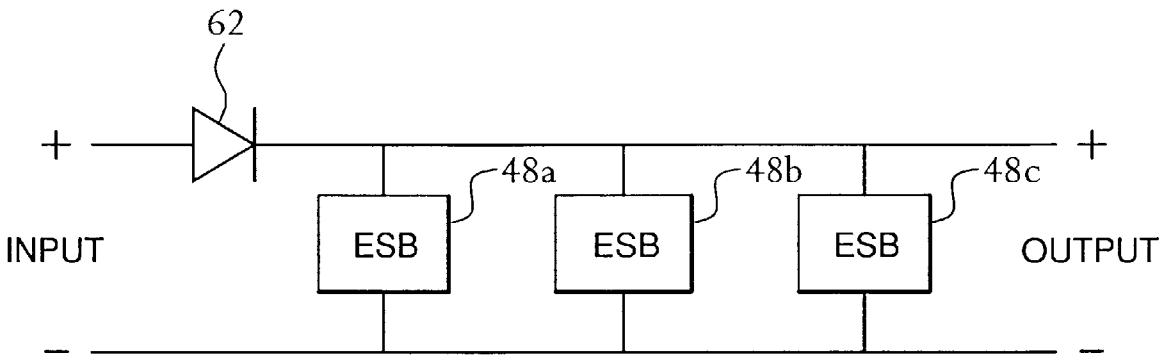
FIG. 9 is a circuit diagram of a rectifier used with plural energy storage banks in accordance with an embodiment of the present invention.
Figure 10:
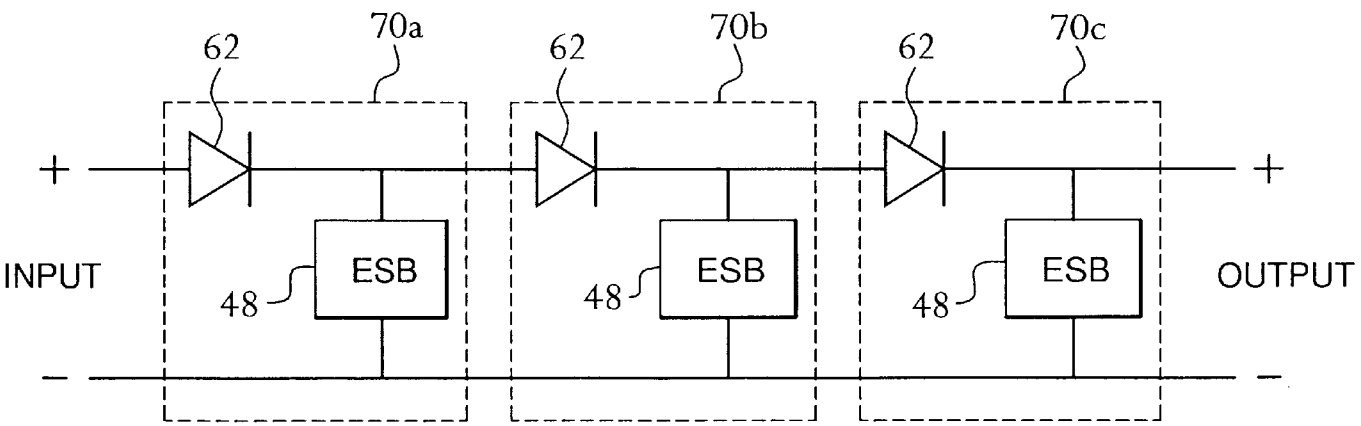
FIG. 10 is a circuit diagram of plural rectifier and energy storage bank circuits in accordance with an embodiment of the present invention.

In addition, a single rectifier 62 can be used in conjunction with a plurality of ESBs 48*a,* 48*b,* 48*c,* and so on, as illustrated in FIG. 9. Only one rectifier 62 is necessary to prevent bleedback into the power distribution system of the crane 10, regardless of the number of ESBs 48 that are used in the lighting system 38. The rectifier 62 is connected externally with respect to the ESBs 48, or the ESB 48*a* that is most proximal with respect to the power supply 40 contains a rectifier, as illustrated by the ESB 68 in FIG. 8. Thus, two types of ESBs are used, that is, one or more ESBs 48 and at least one ESB 68, which is located so as to be most proximal to the power supply 40. Alternatively, a plurality of the ESBs 70*a,* 70*b* and 70*c,* which each have a rectifier 62, can be used, as illustrated in FIG. 10. Thus, only one type of ESB 70 is used. The redundancy of the rectifiers 62 in the ESBs 70*b* and 70*c* does not significantly affect the performance of the lighting system 38. In addition, when one of the redundant rectifiers fails, the remaining rectifiers between the failed rectifier and the ballast allow for some level of bleedback control. This maintenance of bleedback control is not available in the circuit depicted in FIG. 9 following failure of the only rectifier 62. The rectifier(s) 62 described with reference to FIGS. 7 through 10 is preferably selected to have a sufficiently high reverse breakdown voltage to withstand transients in the system. For example, 3000 V rectifiers can be used.

Although the present invention has been described with reference to a preferred embodiment thereof, it will be understood that the invention is not limited to the details thereof. Various modifications and substitutions have been suggested in the foregoing description, and others will occur to those of ordinary skill in the art. All such substitutions are intended to be embraced within the scope of the invention as defined in the appended claims.

What is claimed is:

1. A lighting system for machinery powered via a direct current power bus connected to a direct current power supply, the direct current power bus providing a predetermined steady-state potential, the machinery being provided with a discharge lamp and ballast connected to the direct current power bus, said lighting system comprising an energy storage bank connected in parallel with respect to said direct current power supply and said ballast, said energy storage bank comprising at least one capacitor and operable to maintain a voltage across said ballast corresponding approximately to said steady-state potential of said direct current power bus, and to discharge and at least momentarily sustain a voltage across said ballast when power from said direct current power bus to said ballast decreases below a selected voltage, said energy storage bank operating passively.

2. A lighting system as claimed in claim 1, wherein said selected voltage corresponds to a nominal operating voltage for said ballast to sustain operation of a gas discharge lamp.

3. A lighting system as claimed in claim 1, wherein said energy storage bank comprises a plurality of capacitors arranged in a circuit configuration selected from the group consisting of a first circuit configuration having at least two capacitors connected in parallel with respect to each other and said ballast, a second circuit configuration having at least two capacitors connected in a series circuit that is connected in parallel with respect to said ballast, and a third circuit configuration having two of said second circuit configuration connected in parallel with respect to each other and said ballast.

4. A lighting system as claimed in claim 1, wherein said lighting system further comprises a rectifier connected in series between said direct current power supply and said energy storage bank.

5. A lighting system as claimed in claim 1, wherein said direct current power supply provides a nominal input voltage of approximately 250 volts to said direct current power bus.

6. A lighting system as claimed in claim 5, wherein said selected voltage corresponds to a nominal operating voltage for said ballast to sustain operation of a gas discharge lamp.

7. A lighting system as claimed in claim 6, wherein a minimum operating voltage for said ballast is 120 volts, and said at least one capacitor is selected to have a capacitance C for providing said voltage across said ballast for a selected period of time t which is approximately 50*C.

8. A lighting system for machinery powered via a direct current power bus connected to a direct current power supply, the direct current power bus providing a predetermined steady-state potential, the machinery being provided with a discharge lamp and ballast connected to the direct current power bus and comprising non-lighting loads, said lighting system comprising:

an energy storage bank connected in parallel with respect to said direct current power supply and said ballast, said energy storage bank comprising at least one capacitor and operable to maintain a voltage across said ballast corresponding approximately to said steady-state potential of said direct current power bus, and to discharge and provide a voltage across said ballast when power from said direct current power bus to said ballast decreases below a rated voltage corresponding to said ballast, said energy storage bank operating passively; and a bleedback device connected in series between said direct current power supply and said energy storage bank and operable to prevent any of said non-lighting loads from draining power provided by said energy storage bank when power from said direct current power bus to said ballast decreases below the rated voltage.

9. A lighting system as claimed in claim 8, wherein said bleedback device is a blocking rectifier allowing substantial current flow in only one direction with respect to said direct current power supply.

10. A lighting system as claimed in claim 8, wherein said lighting system comprises a plurality of said energy storage banks, each said energy storage banks being connected in parallel with respect to each other and said ballast, said bleedback device being connected in series between said direct current power supply and the first one of said plurality of energy storage banks that is most proximal with respect to said direct current power supply.

11. A lighting system as claimed in claim 8, wherein said lighting system comprises a plurality of said energy storage banks connected in parallel with respect to each other and said ballast, each said plurality of energy storage banks having one of said bleedback device connected in series with respect to an input thereof.

* * * * *